US005713067A

United States Patent [19]

Mizoe et al.

[11] Patent Number: 5,713,067

[45] Date of Patent: Jan. 27, 1998

[54] CHARGING MEMBER, PROCESS CARTRIDGE USING THE SAME AND ELECTROPHOTOGRAPHIC APPARATUS

[75] Inventors: Kiyoshi Mizoe; Yuzi Ishihara, both of Kawasaki; Eiji Funabashi, Kanagawaken; Tsunenori Ashibe, Yokohama, all of Japan

[73] Assignee: Canon Kabushiki Kaisha, Tokyo, Japan

[21] Appl. No.: 575,701

[22] Filed: Dec. 19, 1995

[30] Foreign Application Priority Data

Dec. 22, 1994 [JP] Japan ..... 6-320690

[51] Int. Cl.[6] ..... G03G 15/02

[52] U.S. Cl. ..... 399/176

[58] Field of Search ..... 355/219, 274, 355/275; 492/18, 53, 56; 361/225; 399/176

[56] References Cited

U.S. PATENT DOCUMENTS

| | | | |
|---|---|---|---|
| 4,810,564 | 3/1989 | Takahashi et al. | 492/56 X |
| 5,089,851 | 2/1992 | Tanaka et al. | 355/219 |
| 5,172,173 | 12/1992 | Goto et al. | 355/275 |
| 5,384,626 | 1/1995 | Kugoh et al. | 355/219 |

FOREIGN PATENT DOCUMENTS

| | | |
|---|---|---|
| 0308185 | 3/1989 | European Pat. Off. . |
| 0329366 | 8/1989 | European Pat. Off. . |
| 0587386 | 3/1994 | European Pat. Off. . |
| 0636949 | 2/1995 | European Pat. Off. . |

*Primary Examiner*—Robert Beatty

*Attorney, Agent, or Firm*—Fitzpatrick, Cella, Harper & Scinto

[57] ABSTRACT

A charging member for charging a charge-receiving member, such as an electrophotographic photosensitive member, by disposing the charging member in contact with the charge-receiving member and applying a voltage to the charging member is constituted by disposing an electroconductive support, an elastic layer, and a surface coating layer having a tensile modulus of above 2000 kgf/cm$^2$ to at most 30000 kgf/cm$^2$ in this order. The coating layer may preferably contain an acrylic polymer-modified urethane resin. The charging member is effective in providing the charge-receiving member with a nip portion showing a uniform electric resistance distribution for a long period to provide excellent images.

19 Claims, 2 Drawing Sheets

CHARGING MEMBER, PROCESS CARTRIDGE USING THE SAME AND ELECTROPHOTOGRAPHIC APPARATUS

FIELD OF THE INVENTION

The present invention relates to a charging member for image formation. Particularly, the present invention relates to a charging member for uniformly charging a charge-receiving member (a member to be charged) by applying a voltage to the charging member disposed in contact with the charge-receiving member, a process cartridge including the charging member, and an electrophotographic apparatus including the charging member.

DESCRIPTION OF THE RELATED ART

In an image forming apparatus including an electrophotographic apparatus, a discharge device using a non-contact charging scheme such as corona charging has generally been used heretofore, as means for charging the surface of a charge-receiving member such as an electrophotographic photosensitive member, a dielectric material, etc. Such a corona charging scheme is effective in uniform chargeability but requires a high applied voltage, thus being accompanied with a problem such as occurrence of ozone.

In contrast to such a corona charging scheme, a contact charging scheme wherein a drive voltage composed of a DC voltage or a DC voltage superposed with an AC voltage is applied to a charging member disposed in contact with a charge-receiving member to charge the charge-receiving member, has been adopted to realize less occurrence of ozone, low voltage charging and cost reduction.

FIG. 2 is a schematic sectional view of an embodiment of a charging roller as a charging member for performing contact charging. Referring to FIG. 2, a charging roller 6 includes an electroconductive support 7 as a supporting member (core metal), an electroconductive elastic layer 8 having an elasticity required to form a uniform nip portion together with the charge-receiving member surface, and a medium-resistive coating layer 9 for controlling a resistivity (electrical resistance) of the charging roller 6.

More specifically, the electroconductive elastic layer 8 may be formed by dispersing an electroconductive substance, such as a metal compound or carbon black, in a solid rubber, such as ethylene-propylene-dien terpolymer (EPDM), nitrile-butadiene rubber (NBR), butyl rubber, acrylic rubber, or urethane rubber. When a drive voltage is applied to the charging roller 6, a charging current (electrification current) passes through the electroconductive elastic layer 8. An elastic foam (foamed elastic material) may be used instead of the solid rubber in order to prevent a charging noise and provide a lightweight charging roller.

The coating layer 9 is a medium-resistive layer which may be formed by dispersing an electroconductive substance as mentioned above in a resin or rubber, such as nylon, polyester or urethane rubber, and is constituted so as not to cause charging failure in an image region even when defects, such as pinholes are caused to occur on the surface of a charge-receiving member (not shown). The coating layer 9 may be controlled to have a desired (electric) resistance value by changing an amount of the electroconductive substance dispersed therein.

As described above, an elastic layer of the charging member may include a solid rubber or elastic foam and has a function of imparting an appropriate nip portion to the charge-receiving member so as to allow a uniform or even contact of the charging member with the charge-receiving member.

On the other hand, many coating layers have been proposed in order to allow a uniform charging based on a uniformity of electric resistance distribution in the coating layers. Examples of such coating layers may include one wherein a dispersibility of an electroconductive substance in a resin is enhanced, one using an electroconductive resin or polymer (e.g., methoxymethylated nylon), one which is physically adjusted to have a uniform thickness, and one which is formed to have a small surface roughness by using a leveling agent or by polishing to improve a contact characteristic thereof with a photosensitive member as the charge-receiving member.

However, even when these coating layers have been used, image defects (e.g., fogs) which may be attributable to non-uniform electric resistance have been liable to occur. This phenomenon is noticeable in the case where the coating layer is left standing for several tens of hours to several days while keeping a constant nip portion with the photosensitive member and thereafter is subjected to image formation. As a result, inferior images (fog images) are formed in the nip shape in some cases.

As a countermeasure thereto, it is possible to apply a method wherein the coating layer is improved in its electroconductivity. In this instance, however, the coating layer is accompanied with a problem of a lowered anti-leakage characteristic in a high-humidity environment. Further, a method wherein a nip pressure is lowered by decreasing a pressing (abutting) force between the charging member and the photosensitive member may be adopted. In this case, however, a slip phenomenon is liable to occur between the charging member and the photosensitive member, thus causing difficulties, such as toner sticking and non-uniform charging in some cases. Accordingly, these methods are insufficient to provide excellent images.

SUMMARY OF THE INVENTION

An object of the present invention is to provide a charging member capable of preventing a change in electric resistance in the vicinity of a nip portion to perform uniform charging for a long period of time thereby to provide excellent images.

Another object of the present invention is to provide a process cartridge and an electrophotographic apparatus each including such a charging member.

According to the present invention, there is provided a charging member, which is disposed in contact with a charge-receiving member and is supplied with a voltage to charge the charge-receiving member, comprising an electroconductive support, an elastic layer disposed on the electroconductive support, and a coating layer disposed on the elastic layer, the coating layer having a tensile modulus of above 2000 kgf/cm$^2$ to at most 30000 kgf/cm$^2$.

According to the present invention, there is also provided a process cartridge, comprising an electrophotographic photosensitive member, a charging member disposed in contact with the photosensitive member and supplied with a voltage to charge the photosensitive member, and at least one of developing means and cleaning means, the charging member comprising an electroconductive support, an elastic layer disposed on the electroconductive support, and a coating layer disposed on the elastic layer, the coating layer having a tensile modulus of above 2000 kgf/cm$^2$ to at most 30000 kgf/cm$^2$, and the photosensitive member, the charging member, and the above-mentioned at least one of developing means and cleaning means being integrally supported to form a cartridge which is detachably mountable to an electrophotographic apparatus main body.

The present invention further provides an electrophotographic apparatus, comprising an electrophotographic photosensitive member, a charging member disposed in contact with the photosensitive member and supplied with a voltage to charge the photosensitive member, exposure means, developing means and transfer means, the charging member comprising an electroconductive support, an elastic layer disposed on the electroconductive support, and a coating layer disposed on the elastic layer, the coating layer having a tensile modulus of above 2000 kgf/cm$^2$ to at most 30000 kgf/cm$^2$.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The charging member according to the present invention is disposed in contact with a charge-receiving member and is supplied with a voltage to charge the charge-receiving member.

The charging member includes an electroconductive support, an elastic layer, and a coating layer disposed in this order.

In the present invention, the coating layer of the charging member has a tensile modulus (modulus in tension) in the range of above 2000 kgf/cm$^2$ to at most 30000 kgf/cm$^2$. Such a charging member is effective in preventing charge irregularity after being left standing for a long time in such a state that the charging member is pressed or abutted against a charge-receiving member, such as a photosensitive member. As a result, a high-quality image free from image defects, such as fog is provided.

This may be attributable to a proper elasticity of the coating layer. More specifically, when a charging member having an elastic layer and a coating layer is pressed or abutted against a photosensitive member, the coating layer is irreversibly deformed at a resultant nip portion and/or the surrounding portion in some cases. In this instance, if the coating layer has a tensile modulus in the range of above 2000 kgf/cm$^2$ to at most 30000 kgf/cm$^2$, the above irreversible deformation of the coating layer is not readily caused, thus not changing a resistance distribution of the coating layer. As a result, the charging member retains a uniform charge-imparting performance.

If the coating layer has a tensile modulus of 2000 kgf/cm$^2$ or below, an electroconductive filler dispersed in a polymeric substance constituting the coating layer is liable to change its dispersion state due to the abutment or pressing, thus changing a resistance value of the coating layer to cause image irregularity. On the other hand, if the coating layer has a tensile modulus of above 30000 kgf/cm$^2$, the coating layer is liable to be cracked When the charging member is repetitively used. As a result, the charging member is remarkably decreased in its anti-leakage characteristic, thus failing to provide excellent images in some cases.

In the present invention, the tensile modulus is determined, e.g., in the following manner.

A tensile modulus of a test piece prepared by cutting a coating layer of the charging member is determined based on a relationship between a change in stress and a change in strain per unit area under an application of load. More specifically, FIG. 4 shows an embodiment of a schematic structural illustration of a measuring apparatus 26 for measuring stress and strain.

Figure 4:
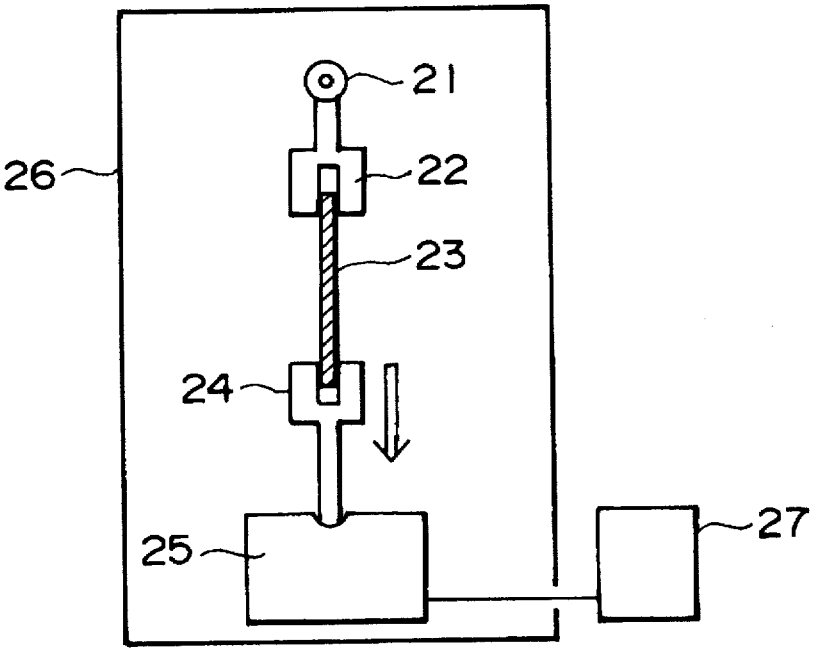
FIG. 4 is a schematic illustration of an embodiment of a stress-strain measuring apparatus.

Referring to FIG. 4, a test piece 23 which is accurately cut for performing precise measurement of a sectional area thereof is held at both terminal ends by grips or clamps 22 and 24. One grip 22 is fixed at a fixed end 21 and the other grip 24 is connected to a loading device 25. The test piece 23 is pulled or stretched in the direction of an arrow, so that a stress-strain (deformation) curve is recorded by a recorder 27 including a load indicator and an extensiometer. A tensile modulus of the test piece 23 is calculated according to the equation shown below based on a relationship between a change in stress and a change in strain in a linear elastic region in the vicinity of an inflection point of a resultant stress-strain curve.

Tensile modulus (kg/cm$^2$)=$\Delta f$ (kg/cm$^2$)/$\Delta h$, wherein $\Delta f$ denotes a change in stress between two points per unit area and $\Delta h$ denotes a change in strain between the above two points. More specifically, $\Delta h$ is equal to a value of $(L-L_0)/L_0$ wherein $L_0$ denotes a length before extension and L denotes a length after extension.

The coating layer having a tensile modulus in the above-mentioned range may be formed by various methods.

Examples of such methods may include: a method wherein an electroconductive filler is blended with a polymeric substance; a method wherein a degree of crosslinking of a polymeric substance is adjusted by adding a crosslinking agent; a method wherein an additive, such as a thickener, coupling agent or pigment is blended with a polymeric substance; and a method wherein a mixing ratio of two or more polymeric substances is controlled. Among these methods, the method of blending the polymeric substance with the electroconductive filler may preferably be used because the tensile modulus is readily adjusted while controlling a resistance or resistivity of a resultant coating layer.

Examples of the polymeric substance may include resins, such as acrylic resin, polyethylene, polyester resin, polyurethane resin, polysulfone resin, epoxy resin, phenolic resin, styrene resin, nylon resin, polyvinyl chloride, alkyd resin, silicone resin, urea resin, melamine resin and fluorine-containing resin; and synthetic rubbers, such as polybutadiene, butadiene-styrene rubber, butadiene-acrylonitrile rubber, polychloroprene, polyisoprene, chlorosulfonated polyethylene, polyisobutylene, isobutylene-isoprene rubber, acrylic rubber, urethane rubber, polysulfide synthetic rubber, fluorine-containing rubber, and silicone rubber. These resins and rubbers may be used singly or in combination of two or more species.

The polymeric substance may preferably have a tensile modulus of 60–10000 kfg/cm$^2$.

Among the above polymeric resins and rubbers, an acrylic polymer-modified urethane resin may preferably to used as the polymeric substance because the acrylic polymer-modified polyurethane is excellent in mechanical strength and durability to suppress abrasion or wear of the surface of the photosensitive member caused by contact of the charging member with the photosensitive member.

The acrylic polymer-modified urethane resin referred to herein means a polymer wherein a polyol component and a polyacrylate component are connected by a urethane bond (linkage). The polyol component may preferably be polyester polyols. The polyacrylate component may preferably be acrylate-styrene copolymers.

Examples of the electroconductive filler may include powder of metals, such as aluminum, nickel, stainless steel, palladium, zinc, iron, copper, or silver; composite metallic powder comprising fiber, zinc oxide, tin oxide, titanium oxide, copper sulfide and/or zinc sulfide; and carbon powder, such as acetylene black, ketjen black, PAN-based carbon or pitch-based carbon. These powders may be used singly or in combination of two or more species.

The electroconductive filler may be used in any amount as long as a resultant coating layer shows a tensile modulus of above 2000 kgf/cm$^2$ to at most 30000 kfg/cm$^2$ and an appropriate resistance. The electroconductive filler may preferably be mixed in an amount of 1–100 wt. parts with 100 wt. parts (as solid matter) of the polymeric substance.

Examples of the crosslinking agent for adjusting a degree of crosslinking may include melamine and melamine compounds in which amino group is substituted with hydrogen atom, aliphatic hydrocarbon group, aromatic hydrocarbon group or derivatives of these groups. Among these compounds, methylol melamine or its derivatives may preferably be used.

Examples of the thickener may include sodium polyacrylate, polymethacrylate acid, ammonium polymethacrylate, and polyethylene oxide.

Examples of the coupling agent may include silane coupling agent, such as γ-(2-aminoethyl) aminopropyltrimethoxysilane, γ-(2-aminoethyl) aminopropyldimethoxysilane, γ-glycidoxypropyltrimethoxysilane, vinyl triacetoxysilane and vinyl trimethoxysilane.

Examples of the pigment may include carbon black, colcothar (red oxide), nigrosine, triphenylmethanes, imidazole metal oxides, metal oxides and chromium compounds of salicylic acid derivatives.

For instance, the coating layer may be formed in the following manner.

To a liquid polymeric substance (e.g., dispersion or solution of acrylic polymer-modified urethane resin), the electroconductive filler is added together with the crosslinking agent, thickener coupling agent and/or pigment, as desired, thus preparing a coating liquid. The coating liquid is applied onto the surface of the elastic layer by, e.g., dipping, spray coating or transfer coating and air-dried, followed by predrying at 30°–90° C. and heating at about 90°–140° C. to form a coating layer on the elastic layer.

In the present invention, the coating layer may preferably have a volume resistivity of $1\times10^5$–$1\times10^{13}$ ohm.cm, more preferably $1\times10^6$–$1\times10^{11}$ ohm.cm. If the volume resistivity is below $1\times10^5$ ohm.cm, dielectric breakdown of the charge-receiving (photosensitive) member is liable to occur under a high-humidity environmental condition. If the volume resistivity exceeds $1\times10^{13}$ ohm.cm, image fog is liable to occur under a low-humidity environmental condition.

The coating layer may preferably have a thickness of 10–1000 μm, particularly 30–300 μm. If the coating layer has a thickness of below 10 μm, dielectric breakdown of the charge-receiving member is liable to occur. If the coating layer has a thickness of above 1000 μm, the resultant charging member fails to sufficiently charge the charge-receiving member in some cases.

The coating layer may be a surface layer or may be covered with another coating layer. Such other coating layer may be prepared in the same manner as in the above-mentioned coating layer by using the materials as mentioned above. Another coating layer may further contain a filler to be dispersed therein as desired. Examples of such a filler may include the above-described electroconductive filler, silica, metal oxides (e.g., alumina), and glass fiber.

The elastic layer of the charging member according to the present invention may preferably have a hardness (ASKER-C hardness) of 20–60 degrees, particularly 30–45 degrees. Below 20 degrees, it becomes impossible to form a uniform layer. Above 60 degrees, a sufficient nip portion between the charging member and the charge-receiving member is not readily formed.

The ASKER-C hardness is determined based on values measured by using a spring-type hardness meter ("ASKER-C Model", mfd. by Kobunshi Keiki K.K.). A test sample for measurement may be prepared by cutting the elastic layer so as to have a thickness of 5 mm by using one or two or more sheets of the elastic layer. The thus prepared test sample is subjected to measurement of ASKER-C hardness by using the above hardness meter under application of a load of 500 g.

Materials for the elastic layer may be any elastic material. Examples of such elastic material may include synthetic rubber, such as EPDM, NBR, butyl rubber, acrylic rubber, urethane rubber, polybutadiene, butadiene-Styrene rubber, butadiene-acrylonitrile rubber, polychloroprene, polyisoprene, chlorosulfonated polyethylene, polyisobutylene, isobutylene-isoprene rubber, fluorine-containing rubber, and silicone rubber; and natural rubbers.

The elastic material may be solid or in the form of a foam. In the present invention, a foamed elastic material may preferably be used because the foamed elastic material is readily controlled to have an appropriate elasticity.

In the present invention, the elastic layer may contain the above-mentioned electroconductive filler to be used in the coating layer in order to impart an appropriate electroconductivity to the elastic layer.

The elastic layer may preferably have a resistance (electric resistance) of $1\times10^2$–$1\times10^9$ ohm, particularly $1\times10^3$–$1\times10^8$ ohm.

If the resistance is below $1\times10^2$ ohm, dielectric breakdown of the charge-receiving member is liable to occur. If the resistance exceeds $1\times10^9$ ohm, it becomes difficult to sufficiently charge the charge-receiving member in some cases.

The elastic layer may preferably have a thickness of 0.5–30 mm, and particularly 1–15 mm. If the elastic layer has a thickness of below 0.5 mm, it becomes difficult to form a sufficient nip portion with the charge-receiving member in some cases. If the elastic layer has a thickness of above 30 mm, an amount of permanent set (permanent strain) is liable to become large, thus resulting in non-uniform charging.

A method of forming the elastic layer may be molding wherein a mold is filled with elastic material to form a molded product, or extrusion wherein an elastic material is extruded from an extruder to form an extruded product.

In the present invention, it is possible to form an intermediate (or adhesion) layer between the coating layer and the elastic layer in order to enhance adhesive properties and/or electroconductivity.

The electroconductive support of the charging member according to the present invention may be formed by using a metallic material, such as iron, copper, stainless steel, aluminum and nickel. The surface of the metallic material may be subjected to plating, as desired, in order to prevent rusting and marring at the metallic material surface. In this instance, however, such a plating-treated metallic material is required to show electroconductivity at its surface.

The charging member may be formed in the shape of, e.g., a roller or a blade. In view of uniform charging properties, the charging member may preferably be formed in a roller shape.

Figure 1:
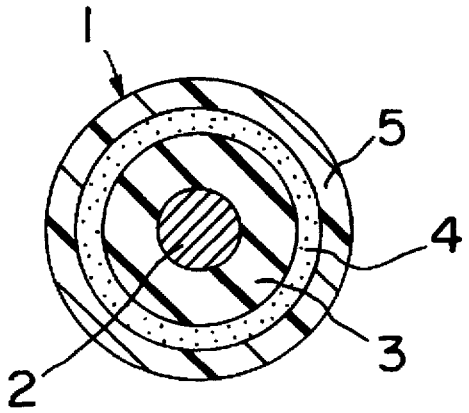
FIG. 1 is a schematic sectional illustration of an embodiment of a roller-shaped charging member according to the present invention.
Figure 2:
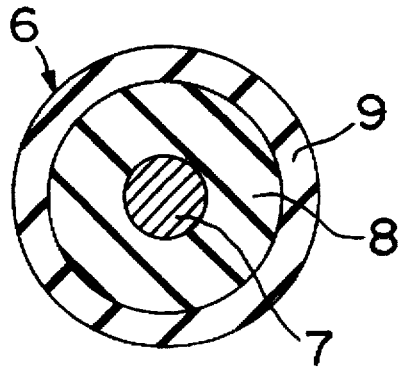
FIG. 2 PRIOR ART
FIG. 2 is a schematic sectional illustration of an embodiment of a roller-shaped charging member.

FIG. 1 is a schematic sectional view of a charging roller as a preferred embodiment of the charging member of the present invention.

Referring to FIG. 1, a charging roller 1 includes an electroconductive support 2, an elastic layer 3, an intermediate (adhesive) layer 4, and a coating layer 5 disposed in this order.

In the present invention, the electrophotographic photosensitive member as the charge-receiving member, exposure means, developing means, cleaning means and transfer means are not restricted particularly.

Figure 3:
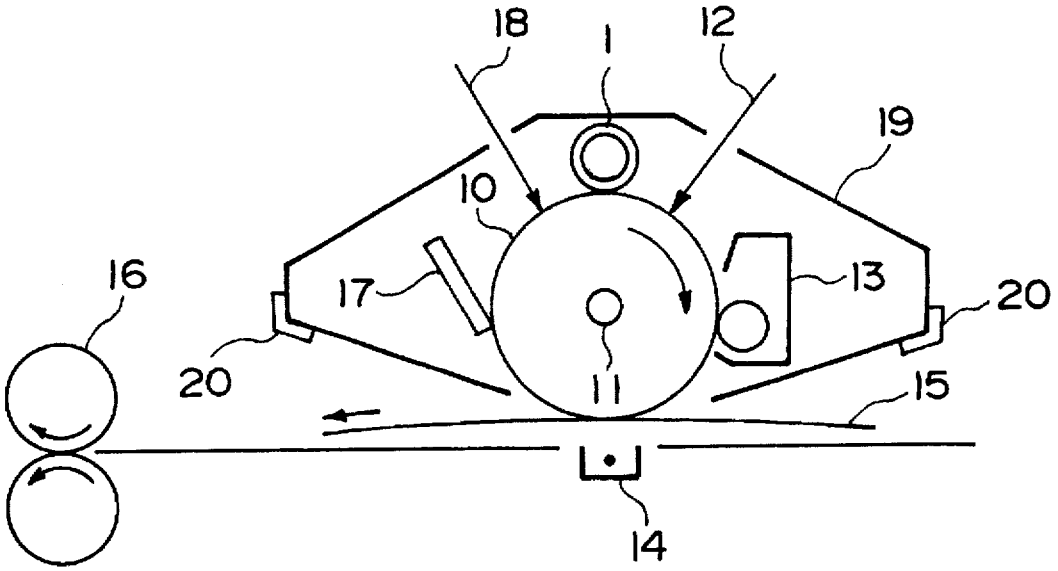
FIG. 3 is a schematic sectional view of an embodiment of an electrophotographic apparatus including a process cartridge using a charging member according to the invention.

FIG. 3 is a schematic sectional view of an embodiment of an electrophotographic apparatus including a process cartridge using the charging member according to the present invention.

Referring to FIG. 3, a photosensitive drum (i.e., electrophotographic photosensitive member) 10 is rotated about an axis 11 at a prescribed peripheral speed in the direction of the arrow shown inside of the photosensitive member 10. The surface of the photosensitive member 10 is uniformly charged by means of a charging member 1 according to the present invention while being rotated to have a prescribed positive or negative potential. The photosensitive member 10 is exposed to light-image 12 (an exposure light beam) as by laser beam-scanning exposure by using an imagewise exposure means (not shown), whereby an electrostatic latent image corresponding to an exposure image is successively formed on the surface of the photosensitive member 10. The thus formed electrostatic latent image is developed by a developing means 13 to form a toner image on the photosensitive member surface. The toner image is successively transferred to a transfer-receiving material 15 which is supplied from a paper-supply part (not shown) to a position between the photosensitive member 10 and a transfer means 14 in synchronism with the rotating speed of the photosensitive member 10, by means of the transfer means 14.

The transfer-receiving material 15 with the toner image thereon is separated from the photosensitive member surface to be conveyed to an image-fixing device 16, followed by image fixing to be printed out as a copy out of the image forming apparatus. Residual toner particles on the surface of the photosensitive member 10 after the transfer are removed by means of a cleaning means 17 to provide a cleaned surface, and residual charge on the surface of the photosensitive member 10 is erased by a pre-exposure light 18 emitted from a pre-exposure means (not shown) to prepare for the next cycle. In case where a contact charging means is used as the charging member 1, the pre-exposure step may be omitted.

In the present invention, a plurality of the above-mentioned structural elements inclusive of the photosensitive member 10, the charging member 1, the developing means 13 and the cleaning means 17 can be integrally supported and assembled into a single unit as a process cartridge 19 which is detachably mountable to a main body of the electrophotographic apparatus, such as a copying machine or a laser beam printer, by using a guide means such as a rail 20 of the apparatus body.

For example, at least one of the developing means 13 and cleaning means 17 may be integrally assembled together with the photosensitive member 10 and the charging member 1 of the invention into a process cartridge 19.

In the case where the electrophotographic apparatus is used as a copying machine or printer, image exposure 12 may be effected by using reflection light or transmitted light from an original or by reading data on the original, converting the data into a signal and then effecting a laser beam scanning, a drive of LED array or a drive of a liquid crystal shutter array in accordance with the signal.

Hereinbelow, the present invention will be more specifically described with reference to Examples.

EXAMPLE 1

A charging roller (charging member) 1 as shown in FIG. 1 was prepared in the following manner.

A 6 mm dia.-core metal 2 of stainless steel (as an electroconductive support) in a length of 251 mm was covered with a urethane foam (average cell diameter= 100–150 μm) prepared by extrusion and containing electroconductive acetylene black. Thereafter, the surface of the urethane foam was polished or abraded to form a 13 mm dia.-cylindrical roller having a 3.5 mm-thick elastic layer 3. The elastic layer 3 showed an ASKER-C hardness of 36 degrees and a resistance of $2\times10^5$ ohm.

Also, 2 wt. parts of aminopropyltrimethoxysilane and 8 wt. parts of polyacrylate were dissolved in a mixture solvent (acetone-isopropyl alcohol) to prepare a solution. The solution was applied onto the elastic layer 3 by dipping and was dried under heating at 100° C. to form an adhesive (intermediate) layer 4.

Then, 29 wt. parts of an electroconductive tin oxide doped with antimony slurry (solid content=51%) and 10 wt. parts of 2 wt. %-γ-(2-aminoethyl)-aminopropylmethyldimethoxysilane aqueous solution (hereinafter referred to as "aminosilane aqueous solution") were dispersed in 58 wt. parts of an acrylic polymer-modified urethane resin aqueous emulsion (solid content= 40%). To the dispersion, 2 wt. parts of a 12 wt. %-ammonium polymethacrylate aqueous solution (as thickener) was added, thus preparing a coating dispersion (viscosity=240 cp±5% (at 23° C.)). The dispersion was applied onto the adhesive layer by dipping and was air-dried under an environment of 23° C. and 50%RH, followed by predrying at 50° C. Thereafter, the coating dispersion was applied onto the resultant surface again, air-dried, predried, and further dried for 45 minutes at 120° C. to form a 120 μm-thick coating layer 5.

The coating layer showed a tensile modulus of 4200 kgf/cm$^2$ and a volume resistivity of $8\times10^8$ ohm. cm. In this instance, the tensile modulus was measured by using an apparatus ("Tensilon RTM-250", mfd. by Orientec Corp.) and a test piece in a sheet form (width=5.0 mm, thickness= 0.5 mm (accurately measured) under conditions including a pulling speed of 5 mm/min., a temperature of 23° C., and a relative humidity of 50%.

The thus prepared charging roller was incorporated in a laser beam printer ("Laser Jet-IV", mfd. by Hewlett-Packard Co.) and subjected to 8000 sheets of image formation (durability test) after left standing for 10 hours, 50 hours and 250 hours (standing time), respectively, under normal temperature-normal humidity (23° C., 60%RH) environmental conditions while retaining a pressing (abutting) state against a photosensitive member under application of two loads each of 500 g (total 1 kg) for providing a nip width of about 2 mm on both lateral ends of the core metal.

A formed image and evaluation method thereof were as follows.

Image: 2 dot-width lines extending in longitudinal direction at a space of 3 dots were formed.

Evaluation: Image defects resulting from charge irregularity were observed by eyes with respect to resultant images at an initial stage and after the durability test, each after a lapse of a prescribed standing time (Image evaluation 1) and image defects resulting from abrasion or wear of the photosensitive member were observed by eyes with respect to resultant images after the durability test after a lapse of a standing time of 10 hours (Image evaluation 2).

Evaluation results are shown in Table 3 appearing hereinafter according to the following evaluation standards.

◎: Very excellent.

o: Excellent (but (practically acceptable) slight image defects were observed).

x: Image defects were observed.

xx: Noticeable image defects were observed.

EXAMPLES 2–4

Charging rollers were prepared and evaluated in the same manner as in Example 1 except that the coating layer was changed to those shown in Table 1 below and that the preparation conditions for the coating layer were changed as follows.

(Example 3)

A 3 wt. %-vinyl triacetoxysilane aqueous solution was used instead of the aminosilane aqueous solution used in Example 1.

(Example 4)

The electroconductive tin oxide doped with antimony was changed to an electroconductive titanium oxide and the addition amount (10 wt. parts) of the aminosilane aqueous solution used in Example 1 was changed to 15 wt. parts.

TABLE 1

| Ex. No. | Polymeric substance | Tensile modulus (kgf/cm$^2$) | Resistivity (ohm · cm) | Thickness (μm) |
|---|---|---|---|---|
| 2 | Polyester urethane | 2200 | $1 \times 10^9$ | 100 |
| 3 | Styrene-acrylate copolymer | 22300 | $1 \times 10^8$ | 150 |
| 4 | Acrylic polymer-modified urethane resin | 8100 | $8 \times 10^8$ | 100 |

The results are shown in Table 3.

EXAMPLES 5–7 AND COMPARATIVE EXAMPLE 1

Charging rollers were prepared and evaluated in the same manner as in Example 1 except that respective coating layers having physical properties shown in Table 2 below were prepared by adding an appropriate amount of melamine (as crosslinking agent) and that the preparation conditions for the coating layer were changed as follows.

(Example 5)

The electroconductive tin oxide doped with antimony was changed to ketjen black.

(Example 7)

The aminosilane aqueous solution was changed to a 2 wt. %-δ-(2-aminoethyl)aminopropyltrimethoxysilane aqueous solution.

TABLE 2

| Ex. No. | Tensile modulus (kgf/cm$^2$) | Resistivity (ohm · cm) | Thickness (μm) |
|---|---|---|---|
| 5 | 8500 | $8 \times 10^8$ | 100 |
| 6 | 18400 | $1 \times 10^9$ | 150 |
| 7 | 27900 | $1 \times 10^9$ | 200 |
| Comp. Ex. 1 | 32000 | $3 \times 10^9$ | 250 |

The results are shown in Table 3.

EXAMPLE 8

A charging roller was prepared and evaluated in the same manner as in Example 1 except that the addition amount of the ammonium polymethacrylate aqueous solution was changed so as to provide a coating dispersion for the coating layer with a viscosity of 670 cp±5%.

The resultant coating layer had a thickness of 150 μm and showed a tensile modulus of 18500 kgf/cm$^2$ and a volume resistivity of $2\times10^9$ ohm.cm.

The results are shown in Table 3.

COMPARATIVE EXAMPLE 2

A charging roller was prepared and evaluated in the same manner as in Example 1 except that the addition amount of the ammonium polymethacrylate aqueous solution was changed so as to provide a coating dispersion for the coating layer with a viscosity of 920 cp±5%.

The resultant coating layer had a thickness of 280 μm and showed a tensile modulus of 37000 kgf/cm$^2$ and a volume resistivity of $6\times10^9$ ohm.cm.

The results are shown in Table 3.

EXAMPLE 9

A charging roller was prepared and evaluated in the same manner as in Example 1 except that the electroconductive tin oxide doped with antimony was changed to a prescribed amount of electroconductive carbon so as to provide the resultant coating layer with a tensile modulus of 6800 kgf/cm$^2$.

The resultant coating layer had a thickness of 90 μm and showed a volume resistivity of $5\times10^6$ ohm.cm.

The results are shown in Table 3.

COMPARATIVE EXAMPLES 3 AND 4

Charging rollers were prepared and evaluated in the same manner as in Example 1 except that the aminosilane aqueous solution was not used and that the electroconductive tin oxide doped with antimony was changed to a prescribed amount (e.g., 15 wt. parts in Comp. Ex. 3) of electroconductive carbon so as to provide the resultant coating layer with tensile moduli of 800 kgf/cm$^2$ (Comp. Ex. 3) and 1900 kgf/cm$^2$ (Comp. Ex. 4), respectively.

The resultant coating layer (Comp. Ex. 3) had a thickness of 180 μm and showed a volume resistivity of $6\times10^8$ ohm.cm, and the resultant coating layer (Comp. Ex. 4) had a thickness of 180 μm and showed a volume resistivity of $2\times10^7$ ohm.cm.

The results are shown in Table 3.

EXAMPLE 10 AND COMPARATIVE EXAMPLE 5

Charging rollers were prepared and evaluated in the same manner as in Example 1 and Comparative Example 3, respectively, except that respective elastic layers were prepared in the following manner.

A 3.5 mm-thick foamed elastic layer was prepared by causing a silicone rubber containing electroconductive ketjen black and azodicarbonamide (as a foaming agent) dispersed therein to foam in a 13 mm-dia. cylindrical mold.

The thus prepared foamed elastic layer showed an ASKER-C hardness of 42 degrees and a resistance of $1\times10^6$ ohm.

The respective coating layers showed tensile moduli of 4150 kgf/cm$^2$ (Example 10) and 810 kgf/cm$^2$ (Comparative Example 5).

The results are shown in the following Table 3.

TABLE 3

| | Tensile | Initial | | | After durability test | | | Image |
|---|---|---|---|---|---|---|---|---|
| Ex. No | modulus (kgf/cm$^2$) | 10 hr. | 50 hr. | 250 hr. | 10 hr. | 50 hr. | 250 hr. | evaluation 2 |
| Ex. 1 | 4,200 | ◎ | ◎ | ◎ | ◎ | ◎ | ◎ | ◎ |
| 2 | 2,200 | ◎ | ◎ | ◎ | ◎ | ◎ | ◎ | ○ |
| 3 | 22,300 | ◎ | ◎ | ◎ | ◎ | ◎ | ◎ | ○ |
| 4 | 8,100 | ◎ | ◎ | ◎ | ◎ | ◎ | ◎ | ◎ |
| 5 | 8,500 | ◎ | ◎ | ◎ | ◎ | ◎ | ◎ | ◎ |
| 6 | 18,400 | ◎ | ◎ | ◎ | ◎ | ◎ | ◎ | ◎ |
| 7 | 27,900 | ◎ | ◎ | ◎ | ◎ | ◎ | ◎ | ◎ |
| 8 | 18,500 | ◎ | ◎ | ◎ | ◎ | ◎ | ◎ | ◎ |
| 9 | 6,800 | ◎ | ◎ | ◎ | ◎ | ◎ | ◎ | ◎ |
| 10 | 4,150 | ◎ | ◎ | ◎ | ◎ | ◎ | ◎ | ◎ |
| Comp. Ex. 1 | 32,000 | x | xx | xx | x | Leakage* | Leakage* | x |
| 2 | 37,000 | xx | xx | xx | Leakage* | Leakage* | Leakage* | xx |
| 3 | 800 | xx | xx | xx | xx | xx | xx | ○ |
| 4 | 1,900 | x | x | xx | x | x | xx | ○ |
| 5 | 810 | xx | xx | xx | xx | xx | xx | ○ |

*Charge leakage occurred.

As is apparent from the above results, the charging member (rollers) including a coating layer showing a tensile modulus in the range of above 2000 kgf/cm$^2$ to at most 30000 kgf/cm$^2$ according to the present invention did not cause charge irregularity or non-uniform charge and abrasion of a photosensitive member even after left standing for a long period of time, thus providing high quality images free from image defects (e.g., fog). Particularly, the charging member including a coating layer using an acrylic polymer-modified urethane resin showed a remarkable abrasion-preventing effect to provide high quality images after the durability test similar to those at the initial stage.

On the other hand, the charging members including a coating layer showing a tensile modulus of at most 2000 kgf/cm$^2$ caused deformation of a nip portion by being left standing in a pressing (abutting) state with the photosensitive member, thus resulting in charge irregularity corresponding to the deformation of the nip portion. In this case, however, no image defects resulting from abrasion of the photosensitive member were observed.

The charging members including a coating layer showing a tensile modulus of above 30000 kgf/cm$^2$ caused a crack in the coating layer at the nip portion or in the vicinity thereof, thus resulting in inferior images with poor image quality. Such charging rollers also caused a charge leakage phenomenon due to accelerated abrasion of the photosensitive member resulting from an expanded crack in the coating layer during the durability test.

What is claimed is:

1. A charging roller, which is disposed in contact with a charge-receiving member and is supplied with a voltage to charge the charge-receiving member, said charging roller comprising:

a electroconductive support;

an elastic layer disposed on said electroconductive support; and a coating layer disposed on said elastic layer, said coating layer being a surface layer and having a tensile modulus of above 2000 kgf/cm$^2$ to at most 30000 kgf/cm$^2$.

2. A charging roller according to claim 1, wherein said coating layer comprises a polymeric substance and an electroconductive filler.

3. A charging roller according to claim 2, wherein said polymeric substance comprises an acrylic polymer-modified urethane resin.

4. A charging roller according to claim 1 or 2, wherein said elastic layer has a hardness of 20–60 degrees.

5. A charging roller according to claim 4, wherein said elastic layer has a hardness of 30–45 degrees.

6. A charging roller according to claim 1 or 2, wherein said elastic layer comprises a foamed material.

7. A charging roller according to claim 1 or 2, wherein the charge-receiving member comprises an electrophotographic photosensitive member.

8. A process cartridge detachably mountable to an electrophotographic apparatus main body, said cartridge comprising:

an electrophotographic photosensitive member;

a charging roller disposed in contact with said photosensitive member and supplied with a voltage to charge said photosensitive member; and at least one of developing means and cleaning means for acting on said photosensitive member, said charging roller including an electroconductive support, an elastic layer disposed on said electroconductive support, and a coating layer disposed on said elastic layer, said coating layer being a surface layer and having a tensile modulus of above 2000 kgf/cm$^2$ to at most 30000 kgf/cm$^2$, and said photosensitive member, said charging roller and said at least one of developing means and cleaning means being integrally supported to form said cartridge.

9. A cartridge according to claim 8, wherein said coating layer comprises a polymeric substance and an electroconductive filler.

10. A cartridge according to claim 9, wherein said polymeric substance comprises an acrylic polymer-modified urethane resin.

11. A cartridge according to claim 8 or 9, wherein said elastic layer has a hardness of 20–60 degrees.

12. A cartridge according to claim 11, wherein said elastic layer has a hardness of 30–45 degrees.

13. A cartridge according to claim 8 or 9, wherein said elastic layer comprises a foamed material.

14. An electrophotographic apparatus, comprising:

an electrophotographic photosensitive member;

a charging roller disposed in contact with said photosensitive member and supplied with a voltage to charge said photosensitive member;

exposure means for exposing said photosensitive member;

developing means for developing a latent image formed on said photosensitive member; and transfer means for transferring a developed image to a recording material, said charging roller including an electroconductive support, an elastic layer disposed on said electroconductive support, and a coating layer disposed on said elastic layer, and said coating layer being a surface layer and having a tensile modulus of above 2000 $kgf/cm^2$ to at most 30000 $kgf/cm^2$.

15. An apparatus according to claim 14, wherein said coating layer comprises a polymeric substance and an electroconductive filler.

16. An apparatus according to claim 15, wherein said polymeric substance comprises an acrylic polymer-modified urethane resin.

17. An apparatus according to claim 14 or 15, wherein said elastic layer has a hardness of 20–60 degrees.

18. An apparatus according to claim 17, wherein said elastic layer has a hardness of 30–45 degrees.

19. An apparatus according to claim 14 or 15, wherein said elastic layer comprises a foamed material.

* * * * *

UNITED STATES PATENT AND TRADEMARK OFFICE

CERTIFICATE OF CORRECTION

PATENT NO. : 5,713,067

DATED : January 27, 1998

INVENTOR(S) : KIYOSHI MIZOE ET AL.

It is certified that error appears in the above-identified patent and that said Letters Patent is hereby corrected as shown below:

On the tile page;

[75] INVENTORS

"Kanagawaken" should read --Kanagawa--.

COLUMN 2

Line 13, "fogs)" should read --fog)--.

COLUMN 4

Line 2, "When" should read --when--.

Line 28, "$(kg/cm^2)=\Delta f(kg/cm^2)/\Delta h$" should read --$(kgf/cm^2)=\Delta f(kgf/cm^2)/\Delta h$--.

Line 65, "to" should read --be--.

COLUMN 9

Line 16, "1)" should read --1);--.

COLUMN 10

Line 6, "$\delta$" should read --$\gamma$--.

UNITED STATES PATENT AND TRADEMARK OFFICE

CERTIFICATE OF CORRECTION

PATENT NO. : 5,713,067

DATED : January 27, 1998

INVENTOR(S) : KIYOSHI MIZOE ET AL.

It is certified that error appears in the above-identified patent and that said Letters Patent is hereby corrected as shown below:

COLUMN 12

Line 53, "roller" should read --roller,--.

Signed and Sealed this

Eighth Day of September, 1998

*Attest:*

*Attesting Officer*

Bruce Lehman

BRUCE LEHMAN

*Commissioner of Patents and Trademarks*